US006257367B1

(12) United States Patent
Allman

(10) Patent No.: US 6,257,367 B1
(45) Date of Patent: Jul. 10, 2001

(54) STAMP-FORMED MUFFLER

(75) Inventor: James R. Allman, North Vernon, IN (US)

(73) Assignee: ArvinMeritor, Inc., Troy, MI (US)

( * ) Notice: Subject to any disclaimer, the term of this patent is extended or adjusted under 35 U.S.C. 154(b) by 0 days.

(21) Appl. No.: 09/264,233

(22) Filed: Mar. 5, 1999

Related U.S. Application Data

(60) Provisional application No. 60/076,848, filed on Mar. 5, 1998.

(51) Int. Cl.[7] ..... F01N 1/02

(52) U.S. Cl. ..... 181/282; 181/272

(58) Field of Search ..... 181/282, 265, 181/266, 269, 272, 276; 28/890.08

(56) References Cited

U.S. PATENT DOCUMENTS

| | | | | |
|---|---|---|---|---|
| 3,638,756 | | 2/1972 | Thiele . | |
| 4,415,059 | | 11/1983 | Hayashi . | |
| 4,456,091 | | 6/1984 | Blanchot . | |
| 4,860,853 | * | 8/1989 | Morning, III | 181/282 |
| 4,901,816 | | 2/1990 | Garey . | |
| 4,909,348 | | 3/1990 | Harwood et al. . | |
| 4,928,372 | | 5/1990 | Harwood et al. . | |
| 4,941,545 | | 7/1990 | Wilcox et al. . | |
| 4,953,660 | | 9/1990 | Jewell, Jr. et al. . | |
| 5,147,987 | | 9/1992 | Richardson et al. . | |
| 5,229,557 | | 7/1993 | Allman et al. . | |
| 5,252,788 | | 10/1993 | Emrick et al. . | |
| 5,332,873 | * | 7/1994 | Kullander et al. | 181/282 |
| 5,563,385 | | 10/1996 | Harwood . | |
| 5,597,986 | | 1/1997 | Harwood et al. . | |
| 5,717,173 | | 2/1998 | Gerber et al. . | |
| 5,816,361 | | 10/1998 | Gerber . | |
| 5,907,904 | | 6/1999 | Gerber et al. . | |

FOREIGN PATENT DOCUMENTS

| | | |
|---|---|---|
| 59-41618 | 3/1984 | (JP) . |
| 56-154512 | 12/1984 | (JP) . |

* cited by examiner

*Primary Examiner*—Khanh Dang
(74) *Attorney, Agent, or Firm*—Barnes & Thornburg

(57) ABSTRACT

A muffler includes an outer shell defining a chamber and a pair of inner plates positioned in the chamber. Each inner plate includes first and second folds partitioning each of the inner plates into a base portion, a first baffle portion, and a second baffle portion. The base portions cooperate to define a first baffle. The first baffle portions cooperate to define a second baffle and the second baffle portions cooperates to define a third baffle. The first, second, and third baffles partition the chamber defined by the outer shell into sub-chambers. The first baffle includes a tube and each of the second and third baffles include a tube-receiving aperture sized to receive the tube of the first baffle.

27 Claims, 4 Drawing Sheets

STAMP-FORMED MUFFLER

This application claims priority under U.S.C. § 119 (e) to U.S. Provisional Application Serial No. 60/076,848, filed Mar. 5, 1998, which is expressly incorporated by reference herein.

This invention relates to exhaust systems and, in particular, to stamp-formed mufflers having stamped outer shells and stamped inner plates. More particularly, this invention relates to stamp-formed mufflers including stamped inner plates having fold-up baffles defining a plurality of chambers between the stamped outer shells.

It is known to construct mufflers using stamp-formed outer shells and inner plates. See, for example, U.S. Pat. No. 5,252,788 to Emrick et al.; U.S. Pat. No. 5,229,557 to Allman et al.; U.S. Pat. No. 5,147,987 to Richardson et al.; U.S. Pat. No. 5,004,069 to Van Blaircum et al.; U.S. Pat. No. 4,941,545 to Wilcox et al.; U.S. Pat. No. 4,860,853 to Moring; U.S Pat. No. 4,736,817 to Harwood; and Re. Pat. No. 33,370 to Harwood.

Stamp-formed mufflers include a plurality of chambers and tubes formed between the stamped outer shells and inner plates. The chambers and tubes direct exhaust gas of the vehicle engine through the muffler in a desired manner to quiet the exhaust noise produced by the vehicle engine effectively.

According to the present invention, a muffler is provided including an outer shell defining a chamber and a pair of inner plates positioned in the chamber. Each inner plate includes first and second folds partitioning each of the inner plates into a base portion, a first baffle portion, and a second baffle portion. The base portions cooperate to define a first baffle. The first baffle portions cooperate to define a second baffle and the second baffle portions cooperates to define a third baffle. The first, second, and third baffles partition the chamber defined by the outer shell into subchambers. The first baffle includes a tube and each of the second and third baffles include a tube-receiving aperture sized to receive the tube of the first baffle.

In a preferred embodiment, the muffler further includes a baffle plate positioned in the chamber. The baffle plate cooperates with the outer shell to further partition the chamber into an additional subchamber and is spaced apart from the first baffle defined by the inner plates.

In another preferred embodiment, the first baffle includes a first edge at the first folds of the inner plates and a second edge spaced apart from the first edge. The first baffle includes at least two tubes extending from the first edge of the first baffle to the second edge of the first baffle.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
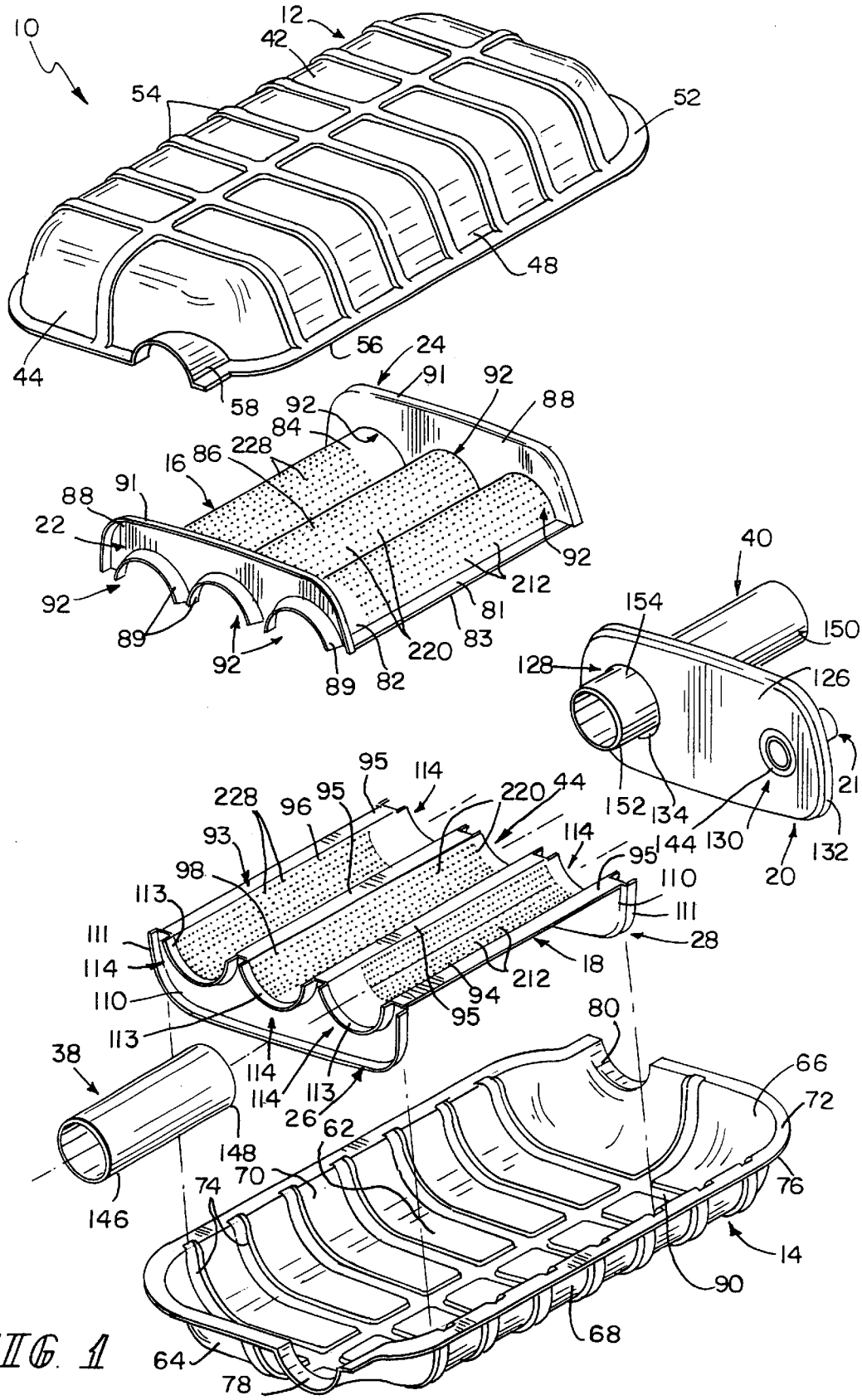
FIG. 1 is an exploded perspective view showing a stamp-formed muffler according to the present invention including top and bottom stamped outer shells having top and bottom walls, first and second stamped inner plates having base portions and spaced-apart fold-up baffle portions extending away from the base portions, a baffle plate, an inlet pipe, an outlet pipe extending through the baffle plate, and a tuning throat extending from the baffle plate.

A stamp-formed muffler 10 according to the present invention is shown in FIG. 1. Stamp-formed muffler 10 includes a stamped top outer shell 12, a stamped bottom outer shell 14, a stamped first inner plate 16, a stamped second inner plate 18, a stamped baffle plate 20, an inlet pipe 38, and an outlet pipe 40 as shown in FIGS. 1–6. First and second inner plates 16, 18 include respective base portions 81, 93 and respective first, second, third, and fourth fold-up baffle portions 22, 24, 26, 28 integrally coupled to respective base portions 81, 93 that cooperate with baffle plate 20 and top and bottom outer shells 12, 14 to define first, second, third, and fourth subchambers 30, 32, 34, 36 between top and bottom outer shells 12, 14 as shown in FIG. 5.

Top and bottom outer shells 12, 14 cooperate to define an outer shell 13 that defines a chamber 31 therein. Chamber 31 is partitioned by first, second, third, and fourth fold-up portions 22, 24, 26, 28 and baffle plate 20 into first, second, third, fourth subchambers 30, 32, 34, 36. Other configurations of outer shells known to those of ordinary skill in the art may also be used with inner plates 16, 18.

Top outer shell 12 includes various contours and edges. Top outer shell 12 includes a top wall 42, first and second end walls 44, 46, first and second side walls 48, 50 extending between first and second end walls 44, 46, and a perimeter flange 52 appended to side walls 48, 50 and end walls 44, 46 as shown in FIGS. 1 and 4–6. First and second end walls 44, 46 and first and second side walls 48, 50 are appended to top wall 42 and arranged to extend from top wall 42 to perimeter flange 52 at a perimeter edge 56 as shown in FIGS. 1 and 4–6. Top wall 42, first and second end walls 44, 46, and first and second side walls 48, 50 include stiffening ribs 54. Stiffening ribs 54 raise the resonant frequency of top outer shell 12 which reduces the vibration of and noise created by top outer shell 12. First end wall 44 includes an inlet passageway 58 and second end wall 46 includes an outlet passageway 60 as shown in FIGS. 1 and 5.

Figure 5:
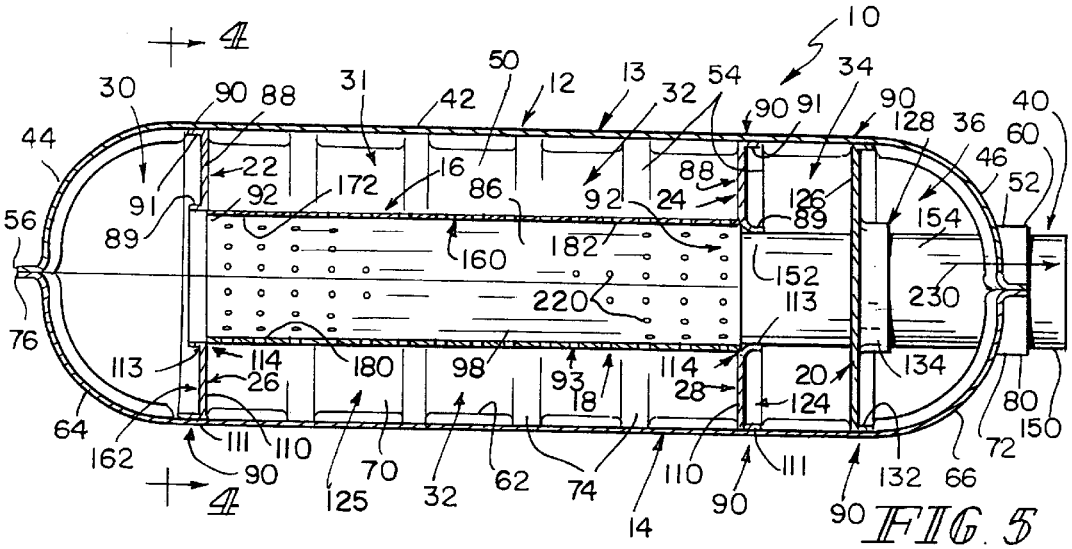
FIG. 5 is a sectional view taken along line 5—5 of FIG. 4, showing the fold-up baffle portions and baffle plate defining a plurality of subchambers between the top and bottom outer shells and the first and second stamped inner plates.
Figure 6:
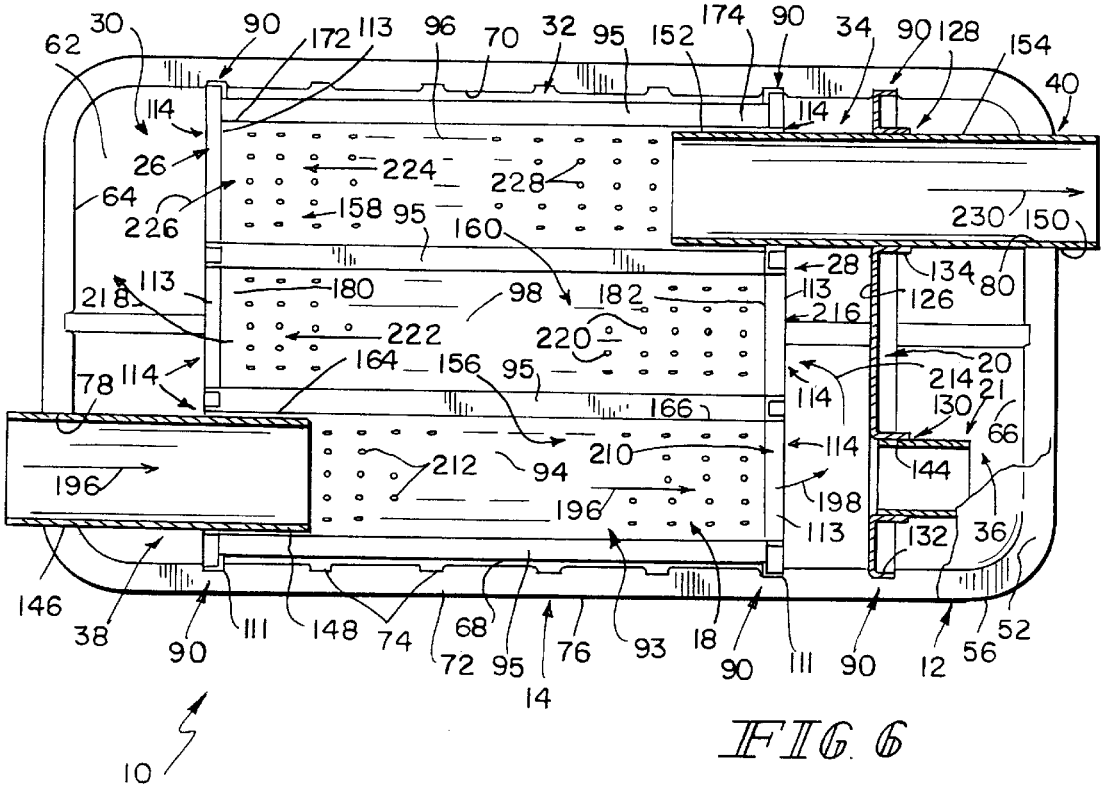
FIG. 6 is a top plan view, with portions broken away, of the muffler showing the flow of exhaust gas along a serpentine path from the inlet pipe through the plurality of tubes to the outlet pipe.

As with top outer shell 12, bottom outer shell 14 also includes various contours and edges. Bottom outer shell 14 includes a bottom wall 62, first and second end walls 64, 66, first and second side walls 68, 70 extending between first and second end walls 64, 66, and a perimeter flange 72 appended to end walls 64, 66 and side walls 68, 70. First and second end walls 64, 66 and first and second side walls 68, 70 are appended to bottom wall 62 and arranged to extend from bottom wall 62 to perimeter flange 72 at a perimeter edge 76 as shown in FIGS. 1 and 4–6. Bottom wall 62, first and second end walls 64, 66, and first and second side walls 68, 70 include stiffening ribs 74. Stiffening ribs 74 raise the resonant frequency of bottom outer shell 14 which reduces the vibration of and noise created by bottom outer shell 14. First end wall 64 includes an inlet passageway 78 and second end wall 66 includes an outlet passageway 80 as shown in FIGS. 1, 5, and 6.

Figure 2:
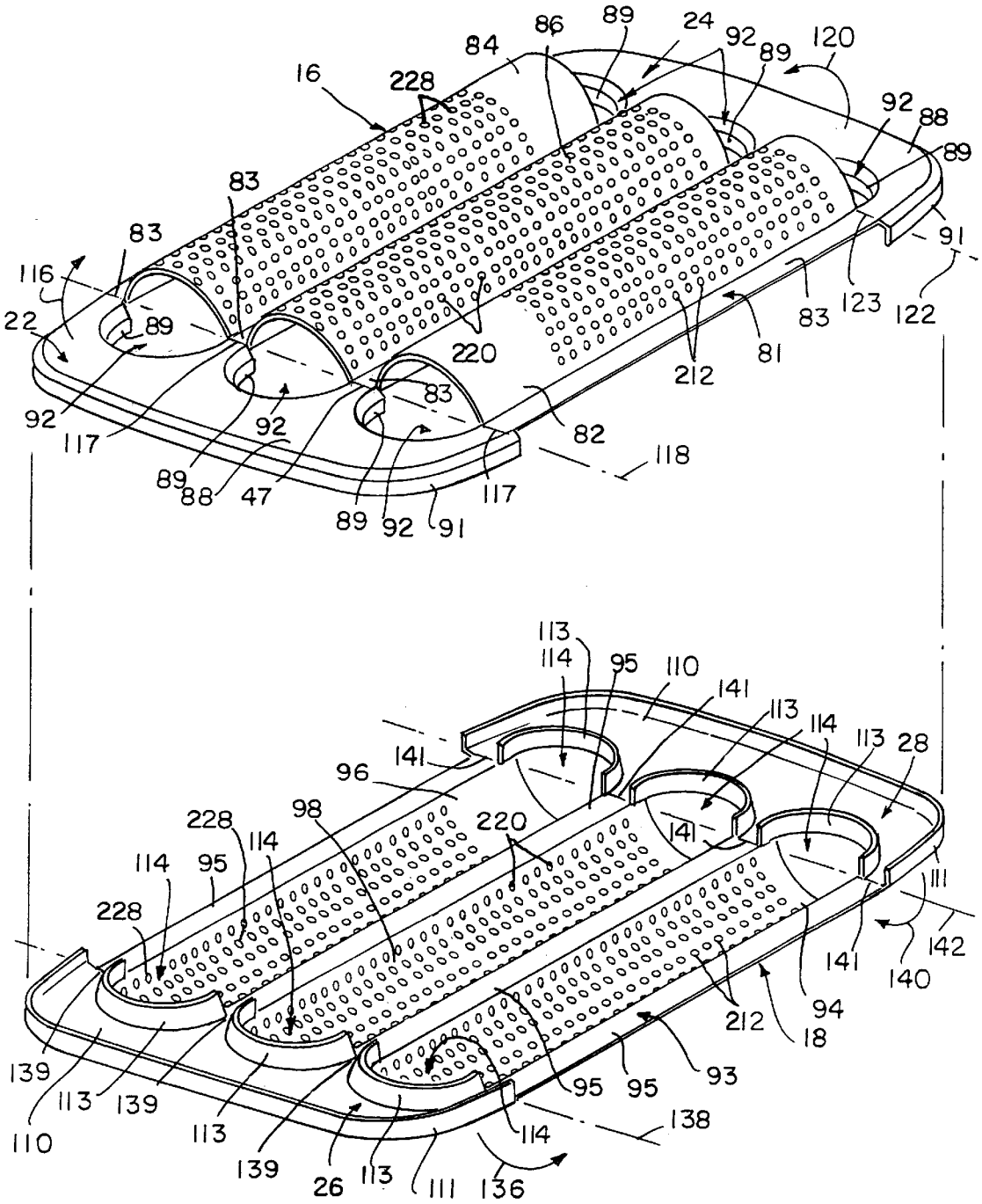
FIG. 2 is an exploded perspective view of the first and second stamped inner plates showing the fold-up baffle portions in their unfolded position.

First and second inner plates 16, 18 are stamped from a sheet of stainless steel into the shapes shown in FIG. 2. In alternative embodiments, the components of the muffler may be stamped from sheets of cold-rolled stainless steel, aluminized stainless steel, or any other appropriate type of material. First inner plate 16 includes base portion 81 and first and second fold-up baffle portions 22, 24 integrally coupled to base portion 81 as shown, for example, in FIGS. 1–3. Base portion 81 includes an inlet channel 82, an outlet channel 84, an intermediate channel 86 positioned between inlet and outlet channels 82, 84, and flat portions 83 positioned between and outside of channels 82, 84, 86 as shown, for example, in FIGS. 1–3. First and second fold-up baffle portions 22, 24 each include a baffle base portion 88, an outer perimeter flange 91 defining an outer perimeter, and curved inner flanges 89 that extend substantially perpendicular to baffle base portions 88 and define circular tube-receiving apertures 92.

Second inner plate 18 is similar to first inner plate 16 and includes base portion 93 and third and fourth fold-up baffle portions 26, 28 integrally coupled to base portion 93. Base portion 93 includes an inlet channel 94, an outlet channel 96, an intermediate channel 98 positioned between inlet and outlet channels 94, 96, and flat portions 95 positioned between and outside of channels 94, 96, 98 as shown in FIGS. 1 and 2. Third and fourth fold-up baffle portions 26, 28 each include a baffle base portion 110, an outer perimeter flange 111 defining an outer perimeter, and curved inner flanges 113 that extend substantially perpendicular to baffle base portions 110 and define circular tube-receiving apertures 114.

First and second inner plates 16, 18 are manipulated from their original unfolded stamped positions as shown in FIG. 2 to their folded positions as shown in FIG. 1. First and second fold-up baffle portions 22, 24 of first inner plate 16 are initially positioned to lie flat in the same plane as flat portions 83 of base portion 81 and similarly, third and fourth fold-up baffle portions 26, 28 of second inner plate 18 are initially positioned to lie flat in the same plane as flat portions 95 of base portion 93. First, second, third, and fourth fold-up baffle portions 22, 24, 26, 28 are then folded from their flat position, shown in FIG. 2, to a folded position as shown in FIGS. 1 and 3–6.

Figure 3:
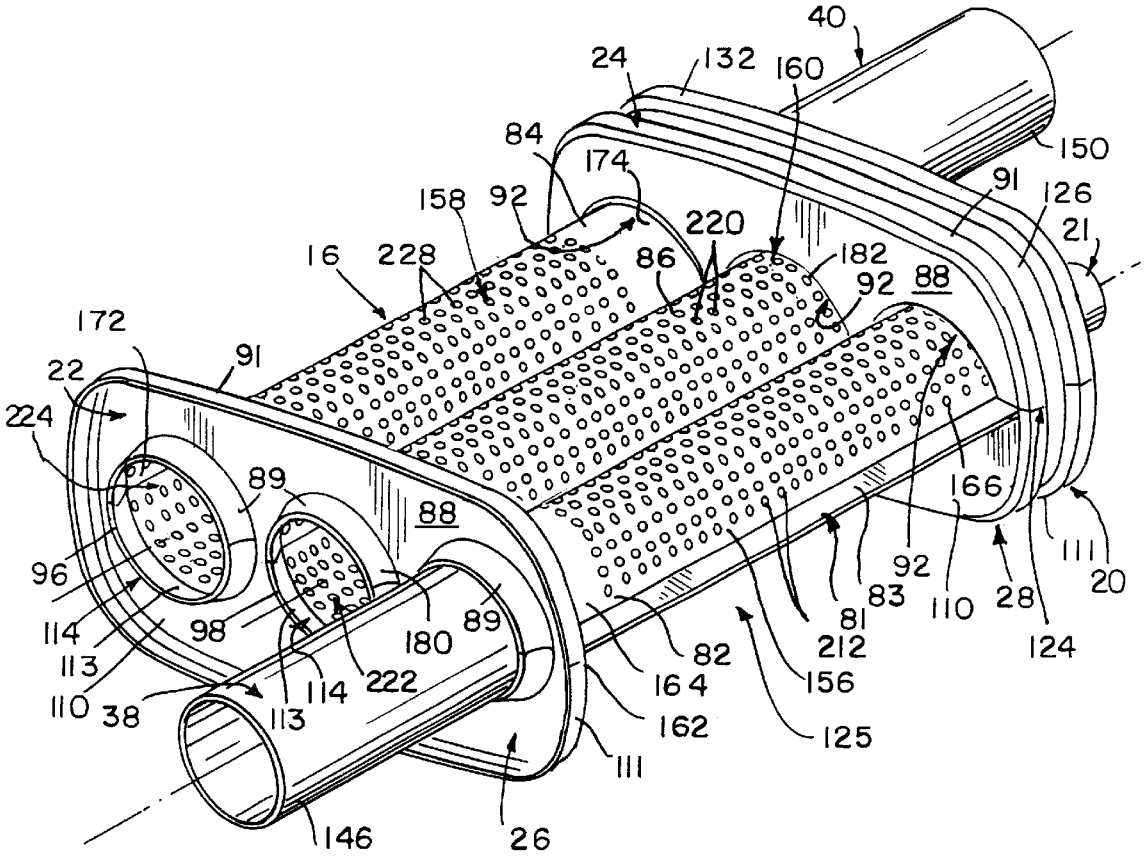
FIG. 3 is a perspective view of the first and second stamped inner plates showing the fold-up baffle portions in their folded positions, the inlet pipe extending from a tube defined by the first and second stamped inner plates, and the baffle plate positioned adjacent to the first and second inner plates.

First fold-up baffle portion 22 is folded 90° in direction 116 about an axis 118 defined by fold 117, as shown in FIG. 2, to reach the folded position shown, for example, in FIGS. 1 and 3, so that flanges 89 engage channels 82, 84, 86 as shown in FIG. 5. Similarly, second fold-up baffle portion 24 is folded 90° in direction 120 about an axis 122 defined by fold 123, as shown in FIG. 2, to reach the folded position shown, for example, in FIGS. 1 and 3, so that flanges 89 engage channels 82, 84, 86 as shown in FIG. 5. Thus, folds 117, 123 partition first inner plate 16 into base portion 81 and first and second fold-up baffle portions 22, 24.

Third fold-up baffle portion 26 is folded 90° in direction 136 about an axis 138 defined by fold 139, as shown in FIG. 2, to reach the folded position shown, for example, in FIGS. 1 and 3, so that flanges 113 engage channels 94, 96, 98 as shown in FIG. 5. Similarly, fourth fold-up baffle portion 28 is folded 90° in direction 140 about an axis 142 defined by fold 141, as shown in FIG. 2, to reach the folded position shown, for example, in FIGS. 1 and 3, so that flanges 113 engage channels 94, 96, 98 as shown in FIG. 5. Thus, folds 139, 141 partition second inner plate 18 into base portion 93 and third and fourth fold-up baffle portions 26, 28. In alternative embodiments of the present invention, the baffle portions can be folded at angles other than 90° to increase or decrease the volume of the subchambers.

After first and second inner plates 16, 18 are positioned adjacent one another, base portions 81, 93 of first and second inner plates 16, 18 cooperate to define a first baffle 125. First and third fold-up baffle portions 22, 26 cooperate to define a second baffle 162 that extends substantially perpendicular from base portions 81, 93 of first and second inner plates 16, 18 as shown, for example, in FIG. 3. Inner flanges 89, 113 of first and third fold-up baffle portions 22, 26 engage inlet channels 82, 94, outlet channels 84, 96, and intermediate channels 86, 98 to form a substantial seal therewith.

Second and fourth fold-up baffle portions 24, 28 cooperate to define a third baffle 124 that extends substantially perpendicular from base portions 81, 93 of first and second inner plates 16, 18 as shown, for example, in FIG. 3. Inner flanges 89, 113 of second and fourth fold-up baffle portions 24, 28 engage inlet channels 82, 94, outlet channels 84, 96, and intermediate channels 86, 98 to form a substantial seal therebetween.

Figure 4:
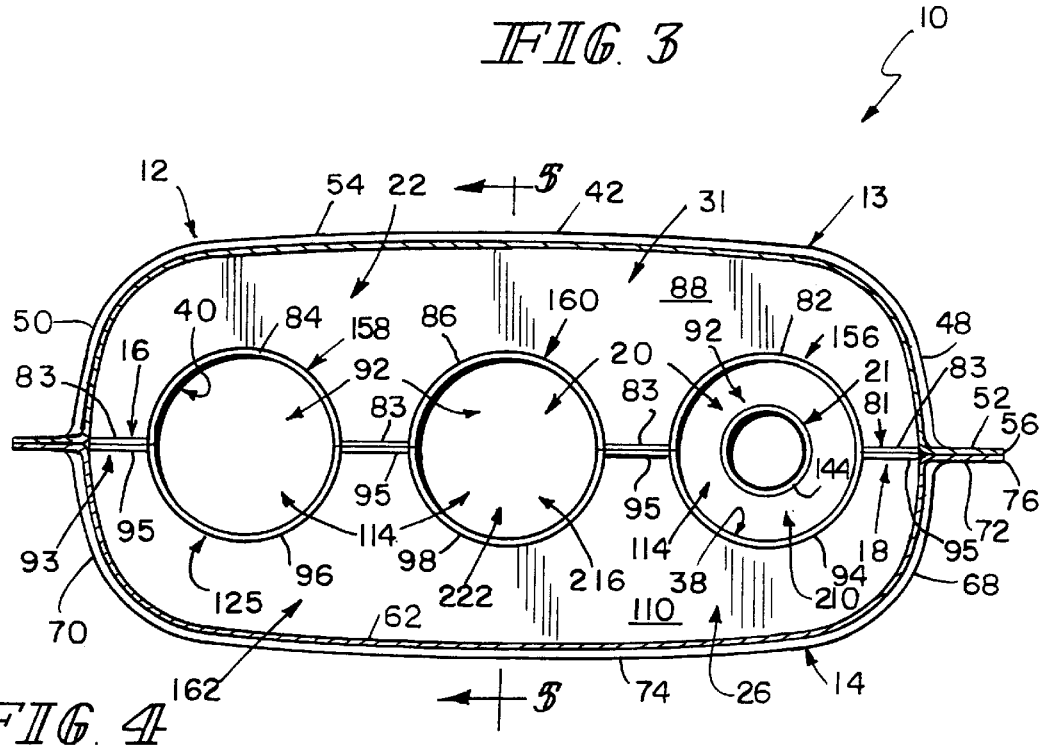
FIG. 4 is a sectional view taken along line 4—4 of FIG. 5 showing the first and second stamped inner plates situated between the top and bottom stamped outer shells, first, second, and third tubes defined by the first and second stamped inner plates, and the tuning throat being concentric with the first tube.

When first and second inner plates 16, 18 mate together, inlet channels 82, 94 cooperate to define a circular inlet tube 156, outlet channels 84, 96 cooperate to define a circular outlet tube 158, and intermediate channels 86, 98 cooperate to define a circular intermediate tube 160 as shown in FIGS. 3 and 4. Inlet tube 156, outlet tube 158, and intermediate tube 160 extend from an edge of first baffle 125 defined by folds 117, 139 to an edge of first baffle 125 defined by folds 123, 141. In preferred embodiments of the present invention, first and second inner plates 16, 18 are coupled together by seam-welding flat portions 83, 95 of first and second inner plates 16, 18.

Inlet and outlet pipes 38, 40 are secured by first and second inner plates 16, 18. Inlet pipe 38 is positioned in tube-receiving apertures 92, 114 between inner flanges 89, 113 adjacent to inlet channels 82, 94 of first and second inner plates 16, 18. When first and second inner plates 16, 18 are mated together, inlet pipe 38 is secured between first and second inner plates 16, 18 by the pressure of first and second inner plates 16, 18 as shown in FIGS. 3, 4, and 6. Similarly, outlet pipe 40 is positioned in tube-receiving apertures 92, 114 between inner flanges 89, 113 adjacent to outlet channels 84, 96 of first and second inner plates 16, 18 as shown in FIGS. 3–6. When first and second inner plates 16, 18 are mated together, outlet pipe 40 is secured by the pressure of first and second inner plates 16, 18. Alternatively, inlet and outlet pipes 38, 40 can be tack-welded or otherwise coupled to the first and second inner plates.

Baffle plate 20 is spaced apart from and positioned to lie substantially parallel to third baffle 124 as shown in FIGS. 3, 5, and 6. Baffle plate 20 accepts outlet pipe 40 and a tuning throat 21. Baffle plate 20 includes a base portion 126, an outer perimeter flange 132 defining an outer perimeter, an outlet pipe-receiving inner flange 134 defining an outlet pipe-receiving aperture 128, and a tuning throat-receiving inner flange 144 defining a tuning throat-receiving opening 130.

Outlet pipe 40 is positioned in outlet pipe-receiving aperture 128 of baffle plate 20 and tuning throat 21 is positioned within tuning throat-receiving opening 130 of baffle plate 20 as shown, for example, in FIGS. 3, 5, and 6. Outlet pipe-receiving inner flange 134 mates with outlet pipe 40 to secure outlet pipe 40 within outlet pipe-receiving aperture 128 so that outlet pipe 40 extends through baffle plate 20 and is secured by a press fit. Tuning throat-receiving inner flange 144 mates with tuning throat 21 to secure tuning throat 21 by a press fit within tuning throat-receiving opening 130 so that tuning throat 21 extends from baffle plate 20. Alternatively, the outlet pipe and tuning throat may be tack-welded or otherwise secured to the baffle plate.

Top and bottom outer shells 12, 14 mate along perimeter edges 56, 76 to secure first and second inner plates 16, 18 and baffle plate 20 between top and bottom outer shells 12, 14 as shown, for example, in FIGS. 4 and 5. Top and bottom outer shells 12, 14 are mated together by welding, crimping, or any other technique of coupling along perimeter edges 56, 76. When first and second inner plates 16, 18 and baffle plate 20 are positioned in first and second outer shells 12, 14, second and third baffles 162, 124 and baffle plate 20 extend from top outer shell 12 to bottom outer shell 14 to assist in defining first, second, third, and fourth subchambers 30, 32, 34, 36 as shown, for example, in FIG. 5.

Base portions 81, 93 of first and second inner plates 16, 18 are not directly connected to top and bottom outer shells 12, 14, but are coupled to top and bottom outer shells 12, 14 through fold-up baffle portions 22, 24, 26, 28 as shown, for example in FIGS. 4–6. Base portion 81 of first inner plate 16 engages base portion 93 of second inner plate 18 when first and second inner plates 16, 18 are connected to define first baffle 125. In an alternative embodiment of the present invention, the base portions of first and second inner plates extend out to lie between the perimeter edges of the top and bottom outer shells. The base portions are then coupled to top and bottom outer shells by crimping, welding, or any other technique of coupling.

Second baffle 162 extends between top wall 42 of top outer shell 12 and bottom wall 62 of bottom outer shell 14. Second baffle 162 is positioned substantially perpendicular to top wall 42 and bottom wall 62 as shown in FIG. 5. Outer perimeter flange 91 of first fold-up baffle portion 22 engages top outer shell 12 and outer perimeter flange 111 of third fold-up baffle portion 26 engages bottom outer shell 14 as shown, for example, in FIG. 5. Stiffening ribs 54, 74 define grooves 90 in which outer perimeter flanges 91, 111 of first and third fold-up baffle portions 22, 26, respectively, nest as shown, for example, in FIGS. 5 and 6.

Third baffle 124 extends between top wall 42 of top outer shell 12 and bottom wall 62 of bottom outer shell 14. Third baffle 124 is positioned substantially perpendicular to top wall 42 and bottom wall 62 as shown in FIG. 5. Outer perimeter flange 91 of second fold-up baffle portion 24 engages top outer shell 12 and outer perimeter flange 111 of fourth fold-up baffle portion 28 engages bottom outer shell 14. Second baffle 162, third baffle 124, top wall 42 of top outer shell 12, bottom wall 62 of bottom outer shell 14, and first and second inner plates 16, 18 cooperate to define second subchamber 32 as shown, for example, in FIG. 5. Outer perimeter flanges 91, 111 of second and fourth fold-up baffle portions 24, 28 nest within grooves 90 defined by stiffening ribs 54, 74.

Baffle plate 20 extends between top wall 42 of top outer shell 12 and bottom wall 62 of bottom outer shell 14 to lie substantially parallel to third baffle 124 as shown in FIGS. 5 and 6. Outer perimeter flange 132 of baffle plate 20 engages top and bottom outer shells 12, 14 to define third subchamber 34 between top and bottom outer shells 12, 14, third baffle 124, and baffle plate 20 as shown, for example, in FIG. 5. Baffle plate 20 also cooperates with top and bottom outer shells 12, 14 to define fourth subchamber 36 as shown, for example, in FIG. 5. Outer perimeter flange 132 of baffle plate 20 nests in grooves 90 defined by stiffening ribs 54, 74. In an alternative embodiment of the present invention, the flanges of the baffles are not nested in grooves but free-float between the top and bottom outer shells. Likewise, the flanges of the baffles may be welded or otherwise coupled to the top and bottom outer shells.

In preferred embodiments of the present invention, muffler 10 includes tuning throat 21. Tuning throat 21 is positioned in tuning throat-receiving opening 130 to extend into fourth subchamber 36 and engage tuning throat-receiving inner flange 144 to form a substantial seal therebetween as shown, for example, in FIGS. 1 and 6. Fourth subchamber 36 is a Helmholtz tuning chamber for attenuating low frequency noise.

Muffler 10 is positioned within an exhaust system (not shown) to attenuate noise within the exhaust system as the exhaust gas travels through muffler 10. Inlet pipe 38 communicates with an exhaust pipe (not shown) or another component of the exhaust system (not shown) and inlet tube 156. Inlet pipe 38 includes a first end 146 that is positioned within an inlet pipe-receiving aperture provided by inlet passageways 58, 78 of top and bottom outer shells 12, 14 and a second end 148 positioned within inlet tube 156 of first and second inner plates 16, 18.

Inlet tube 156 communicates with inlet pipe 38 and third subchamber 34. Inlet tube 156 includes spaced-apart first and second open ends 164, 166 as shown, for example, in FIGS. 3 and 6. First open end 164 receives and secures second end 148 of inlet pipe 38. Second open end 166 of inlet tube 156 is positioned adjacent to second and fourth fold-up baffle portions 24, 28 as shown, for example, in FIGS. 5 and 6. Inner flanges 89, 113 of second and fourth fold-up baffle portions 24, 28 engage second open end 166 of inlet tube 156 to form a substantial seal therebetween to assist in defining second and third subchambers 32, 34.

Intermediate tube 160 communicates with first and third subchambers 30, 34. Intermediate tube 160 includes a first open end 180 positioned adjacent to first and third fold-up baffle portions 22, 26 and a second open end 182 positioned adjacent to second and fourth fold-up baffle portions 24, 28 as shown, for example, in FIGS. 3 and 6. Inner flanges 89, 113 of second and fourth fold-up baffle portions 24, 28 engage second open end 182 of intermediate tube 160 to form a substantial seal therebetween to assist in defining second and third subchambers 32, 34. Inner flanges 89, 113 of first and third fold-up baffle portions 22, 26 engage first open end 180 of intermediate tube 160 to form a substantial seal therebetween to assist in defining first and second subchambers 28, 30.

Outlet tube 158 communicates with first subchamber 30 and outlet pipe 40. Outlet tube 158 includes spaced-apart first and second open ends 172, 174. First open end 174 receives and secures second end 152 of outlet pipe 40 as shown for example in FIGS. 5 and 6. Inner flanges 89, 113 of first and third fold-up baffle portions 22, 26 engage second open end 172 of outlet tube 158 as shown, for example, in FIGS. 5 and 6 to form a substantial seal therebetween to assist in defining first and second subchambers 30, 32.

Outlet pipe 40 communicates with an exhaust pipe (not shown) or another component of the exhaust system (not shown). Outlet pipe 40 includes a first end 150 that is positioned within an outlet pipe-receiving aperture provided by outlet passageways 60, 80 of top and bottom outer shells 12, 14, a second end 152 coupled to first and second inner plates 16, 18, and a middle region 154. Middle region 154 of outlet pipe 40 is positioned within outlet pipe-receiving aperture 128 of baffle plate 20 and is coupled to outlet pipe-receiving inner flange 134 of baffle plate 20 to form a substantial seal therebetween.

Exhaust gas flows through a serpentine path through muffler 10 between inlet pipe 38 and outlet pipe 40. Exhaust gas enters muffler 10 through first end 146 of inlet pipe 38 in direction 196 as shown in FIG. 6. Exhaust gas exits inlet pipe 38 in direction 196 and enters first open end 164 of inlet tube 156. Exhaust gas flows through inlet tube 156 and exits inlet tube 156 in direction 198 into third subchamber 34. Second open end 166 defined by inlet tube 156 defines an exhaust gas passage 210 through which exhaust gas flows from inlet tube 156 into third subchamber 34. Inlet tube 156 includes perforations 212 through which exhaust gas in inlet tube 156 communicates with second subchamber 32.

Once exhaust gas is in third subchamber 34, exhaust gas communicates with fourth subchamber 36 through tuning throat 21. Exhaust gas continues flowing in direction 214 from third subchamber 34 into intermediate tube 160 as shown in FIG. 6. Second open end 182 defined by intermediate tube 160 provides an exhaust gas passage 216 through which exhaust gas flows from third subchamber 34 into intermediate tube 160. Exhaust gas flows through intermediate tube 160 and exits intermediate tube 160 in direction 218 into first subchamber 30 as shown in FIG. 6. First open end 180 defined by intermediate tube 160 provides an exhaust gas passage 222 through which exhaust gas flows from intermediate tube 160 into first subchamber 30 as shown in FIG. 6. Intermediate tube 160 includes perforations 220 through which exhaust gas communicates with second subchamber 32.

Exhaust gas flows through first subchamber 30 from first open end 180 of intermediate tube 160 to first open end 172 of outlet tube 158 as shown in FIG. 6. Exhaust gas flows in direction 226 from first subchamber 30 into outlet tube 158. First open end 172 defined by outlet tube 158 provides an exhaust gas passage 224 through which exhaust gas flows from first subchamber 30 into outlet tube 158. Outlet tube 158 includes perforations 228 through which exhaust gas in outlet tube 158 communicates with second subchamber 32. In alternative embodiments of the present invention, the inlet tube, outlet tube, and intermediate tube may include louvers or any other type of aperture instead of perforations or any or all of the inlet tube, outlet tube, and intermediate tube may not include perforations, louvers, or apertures.

Exhaust gas enters second end 152 of outlet pipe 40 through second open end 174 of outlet tube 158 as shown, for example, in FIGS. 5 and 6. Exhaust gas flows through outlet pipe 40 and exits muffler 10 in direction 230 through first end 150 of outlet pipe 40 as shown in FIGS. 5 and 6.

Muffler 10 includes five stamped parts 12, 14, 16, 18, 20 (top and bottom stamped outer shells 12, 14, first and second stamped inner plates 16, 18, and stamped baffle plate 20) that form three tubes 156, 158, 160 and four subchambers 30, 32, 34, 36 for exhaust gas to flow through muffler 10 when used in combination with inlet and outlet pipes 38, 40.

Although the invention has been disclosed in detail with reference to certain preferred embodiments, variations and modifications exist within the scope and spirit of the invention.

What is claimed is:

1. A muffler comprising an outer shell defining a chamber therein, a baffle plate positioned in the chamber, and a pair of inner plates positioned in the chamber, each inner plate including first and second folds partitioning each of the inner plates into a base portion, a first baffle portion, and a second baffle portion, the base portions cooperating to define a first baffle, the first baffle portions cooperating to define a second baffle, the second baffle portions cooperating to define a third baffle, the first, second, and third baffles partitioning the chamber into subchambers, the baffle plate being spaced apart from the first baffle, the first baffle including a first edge at the first fold of the inner plates and a second edge at the second folds of the inner plates, the first baffle including at least two tubes extending from the first edge of the first baffle to the second edge of the first baffle, and the second and third baffles including tube-receiving apertures sized to receive the tubes of the first baffle.

2. The muffler of claim 1, wherein the outer shell includes grooves and the baffle plate, second baffle, and third baffle include outer perimeters positioned in the grooves.

3. The muffler of claim 1, wherein the first baffle includes at least three tubes.

4. The muffler of claim 1, further comprising a pipe, wherein the baffle plate includes a pipe-receiving aperture, the pipe is positioned in the chamber, the pipe-receiving aperture, and one of the tubes of the first baffle.

5. The muffler of claim 4, further comprising another pipe positioned in the chamber and one of the tubes of the first baffle.

6. A muffler comprising an outer shell defining a chamber therein and a pair of inner plates positioned in the chamber, each inner plate including first and second folds partitioning each of the inner plates into a base portion, a first baffle portion, and a second baffle portion, the base portions cooperating to define a first baffle, the first baffle portions cooperating to define a second baffle, the second baffle portions cooperating to define a third baffle, the first, second, and third baffles partitioning the chamber into subchambers, the first baffle including a tube, and each of the second and third baffles including a tube-receiving aperture sized to receive the tube of the first baffle.

7. The muffler of claim 6, wherein the second baffle includes a base portion and a flange coupled to the base portion and the flange defines the tube-receiving aperture of the second baffle and engages the tube.

8. The muffler of claim 7, wherein the flange extends substantially perpendicular to the base portion of the second baffle.

9. The muffler of claim 7, wherein the flange is curved.

10. The muffler of claim 7, wherein the tube is circular and the tube-receiving aperture is circular.

11. The muffler of claim 6, wherein the first baffle includes at least two tubes, each of the second and third baffles include at least two tube-receiving apertures sized to receive the tubes.

12. The muffler of claim 6, further comprising a pipe positioned in the chamber and one of the tube-receiving apertures.

13. The muffler of claim 12, wherein the second baffle includes a base portion and a flange coupled to the base portion, the flange defines the tube-receiving aperture of the second baffle and engages the pipe.

14. A muffler comprising an outer shell defining a chamber therein, a baffle plate positioned in the chamber, and a pair of inner plates positioned in the chamber, each inner plate including a fold partitioning each of the inner plates into a base portion and a baffle portion, the base portions cooperating to define a first baffle, the baffle portions cooperate to define a second baffle, the first and second baffles and the baffle plate partitioning the chamber into subchambers, the baffle plate being spaced apart from the first baffle.

15. The muffler of claim 14, wherein each of the inner plates include another fold partitioning each of the inner plates into an additional baffle portion, the additional baffle portions cooperate to define a third baffle.

16. The muffler of claim 14, wherein the first baffle includes a tube and the second baffle includes a tube-receiving aperture sized to receive the tube.

17. The muffler of claim 14, further comprising a pipe, the baffle plate including a pipe-receiving aperture, and the pipe being positioned in the chamber and the pipe-receiving aperture.

18. The muffler of claim 17, wherein the first baffle includes a tube and the pipe is positioned in the tube.

19. The muffler of claim 17, wherein the outer shell includes a pipe-receiving aperture and the pipe is positioned in the pipe-receiving aperture of the outer shell.

20. The muffler of claim 17, wherein the baffle plate includes an opening spaced apart from the pipe-receiving aperture.

21. The muffler of claim 17, wherein the baffle plate includes a base portion and a flange coupled to the base portion, the flange defines the pipe-receiving aperture of the baffle plate, and the flange engages the pipe.

22. A muffler comprising an outer shell defining a chamber therein and a pair of inner plates positioned in the chamber, each inner plate including a fold partitioning each of the inner plates into a base portion and a baffle portion, the base portions cooperating to define a first baffle, the baffle portions cooperate to define a second baffle, the first and second baffles partitioning the chamber into subchambers, the first baffle including a first edge at the folds of the inner plates and a second edge spaced apart from the first edge, the first baffle includes at least two tubes extending from the first edge of the first baffle to the second edge of the first baffle.

23. The muffler of claim 22, wherein the outer shell includes groove and the second baffle includes a perimeter positioned in the groove.

24. The muffler of claim 22, wherein the first baffle includes first, second, and third tubes extending from the first edge of the first baffle to the second edge of the first baffle.

25. The muffler of claim 24, further comprising an inlet pipe and an outlet pipe, the second tube being positioned between the first and third tubes, the inlet pipe being positioned in the chamber and the first tube, and the outlet pipe being positioned in the chamber and the third tube.

26. The muffler of claim 22, wherein the first, second, and third tubes are spaced apart.

27. The muffler of claim 22, further comprising a pipe, the pipe being positioned in the chamber and one of the tubes of the first baffle.

* * * * *